US007984564B2

(12) United States Patent
Weigel

(10) Patent No.: US 7,984,564 B2
(45) Date of Patent: Jul. 26, 2011

(54) INTEGRAL ILLUMINATED OPTICAL CENTER FINDER AND MARKING TOOL

(75) Inventor: Matthew J. Weigel, Bonnney Lake, WA (US)

(73) Assignee: The Boeing Company, Chicago, IL (US)

( * ) Notice: Subject to any disclaimer, the term of this patent is extended or adjusted under 35 U.S.C. 154(b) by 276 days.

(21) Appl. No.: 12/350,153

(22) Filed: Jan. 7, 2009

(65) Prior Publication Data

US 2010/0170100 A1 Jul. 8, 2010

(51) Int. Cl.
*B25D 5/00* (2006.01)

(52) U.S. Cl. ..... 33/670; 33/677; 30/366; 359/809; 362/119

(58) Field of Classification Search ..... 33/644, 33/666, 670, 671, 673, 677–679, 574, 577, 33/579; 83/667, 669, 681, 682, 684; 30/366, 30/367; 359/809, 810; 362/109, 118, 119
See application file for complete search history.

(56) References Cited

U.S. PATENT DOCUMENTS 2,612,222 A * 9/1952 Sterba et al. ..... 30/358
2,730,811 A * 1/1956 Gouldsmith, Jr. ..... 33/677
2,934,829 A * 5/1960 Bohn ..... 33/677
3,153,860 A * 10/1964 Sidlauskas ..... 33/677
3,703,142 A * 11/1972 Mimlitch ..... 101/389.1
3,719,999 A * 3/1973 Harrington ..... 33/27.02
4,137,561 A * 1/1979 Andree ..... 362/119
4,262,426 A * 4/1981 Miyazaki ..... 359/368
6,036,332 A * 3/2000 Antal ..... 362/119
7,082,694 B2 * 8/2006 Lyman, Jr. ..... 33/670
7,204,024 B2 * 4/2007 Hubbs ..... 30/367
2005/0274033 A1 * 12/2005 Kraemer ..... 33/645

OTHER PUBLICATIONS

U.S. Appl. No. 12/330,249, filed Dec. 8, 2008, Weigel, Jr., Matthew J; Mally, Sujith N., "Method and Apparatus for Removing Blind Fasteners".
"On Mark Optical Center Punch", <<http://www.productsusa.com/howtouseom.html>> Retrieved on Dec. 15, 2008, 1 page.

* cited by examiner

*Primary Examiner* — Amy Cohen Johnson
(74) *Attorney, Agent, or Firm* — Caven & Aghevli LLC

(57) ABSTRACT

Apparatus and methods associated with a center finder and marking tool are disclosed. A center finder and marking tool device includes a base that is configured to be positioned on a work piece surface. The base includes a bore hole. A body is disposed inside the bore hole and rotationally coupled to the base, wherein the body includes a first bore tunnel and a second bore tunnel. An optical center finder is disposed inside the first bore tunnel, and a marking tool is disposed inside the second bore tunnel.

28 Claims, 10 Drawing Sheets

INTEGRAL ILLUMINATED OPTICAL CENTER FINDER AND MARKING TOOL

TECHNICAL FIELD

The present disclosure relates to systems and methods for marking a work piece, and more specifically, to systems and methods for using an optical center finder component to find a designated spot on a work piece for further processing.

BACKGROUND

The surfaces of work pieces, such as surfaces of components of an aircraft, are often provided with tool markings during manufacturing and/or assembly. These tool markings may serve as guides for further tooling, such as the drilling of holes and the placement of fasteners. A commonly used tool for the marking of work pieces is a center punch. The center punch is generally a hard metal rod with a sharpened tip for making impressions into the surface of the work piece. Additionally, prior to using a center punch, a work piece may be initially scribed with non-penetrative preliminary markings (e.g., ink or pencil-based markings).

Existing center punches have been cumbersome and difficult to use. In one example, a center punch guide that removably holds the center punch may be positioned by an operator at a desired location on the work piece according to the preliminary markings. The center punch guide may be positioned relative to the preliminary markings with the use of an optical center finder component that is temporarily installed into the guide to replace the center punch. The optical center finder component may enable the operator to observe the preliminary markings and maneuver the center punch guide into the desired location on the work piece surface. Once the guide is maneuvered to the desired location, the optical center finder component may be disassembled from the guide and replaced with the center punch for making the tool marking. The center punch may then be propelled with a blunt force into the surface of the work piece by the operator, thereby making the needed tool marking. Assembly and disassembly of the center punch, the center punch guide, and the optical center finder component during positioning and use may result in loss or misplacement of the components, leading to inefficiency and additional replacement cost. Additionally, it is often difficult to view preliminary markings through the optical center finder, particularly in low light conditions.

Therefore, it would be advantageous to have an apparatus and a method that overcomes one or more of the issues described above.

SUMMARY

Systems and methods for positioning a center finder and marking tool device on the surface of a work piece for the placement of tool markings are disclosed. These novel systems and methods enable the use of an integral marking device that includes an integrated optical center finder component, an integrated tool guide component, and an integrated work piece marking tool component. Accordingly, embodiments of systems and methods in accordance with the present disclosure may advantageously provide a mechanism for marking a work piece at the desired location without the need to assemble and disassemble tool components.

In various embodiments, a center finder and marking tool device for marking a work piece surface includes a base that is configured to be positioned on a work piece surface. The base includes a bore hole. A body is disposed inside the bore hole and rotationally coupled to the base, wherein the body includes a first bore tunnel and a second bore tunnel. An optical center finder is disposed inside the first bore tunnel, and a marking tool is disposed inside the second bore tunnel.

In other embodiments, a method of marking a work piece surface includes positioning a center finder and marking tool device on a work piece surface, and centering an optical center finder of the device on a location on the work piece surface. The method further includes rotating a body of the device to center the marking tool at the location previously occupied by the optical center finder. The method also includes marking the work piece surface with the marking tool.

In additional embodiments, a method of assembling a center finder and marking tool device includes providing a base that includes a bore hole, wherein the base is configured to be positioned on a work piece surface. The method further includes coupling a body that includes a first bore tunnel and a second bore tunnel to the base via the bore hole. The body is configured to rotate inside the bore hole. The method also includes disposing an optical center finder inside the first bore tunnel and a marking tool inside the second bore tunnel.

The features, functions, and advantages that have been discussed above or will be discussed below can be achieved independently in various embodiments, or may be combined in yet other embodiments, further details of which can be seen with reference to the following description and drawings.

BRIEF DESCRIPTION OF THE DRAWINGS

The detailed description is described with reference to the accompanying figures. In the figures, the left-most digit(s) of a reference number identifies the figure in which the reference number first appears. The use of the same reference number in different figures indicates similar or identical items.

DETAILED DESCRIPTION

Systems and methods in accordance with the present disclosure are directed to embodiments of an integral illuminated optical center finder and marking tool device that reduces or eliminates the need to assemble and disassemble an optical center finder, a marking tool (e.g., center punch), and a marking tool guide (e.g., a center punch/optical center finder guide). The integral illuminated optical center finder and marking tool may be used in, among other applications, the manufacturing and assembly of aircraft components. Accordingly, by reducing or eliminating the need to assemble and dissemble marking tool components during the marking of a work piece surface, the integral illuminated optical center finder and marking tool device may improve efficiency in marking the surface of work pieces, as well as reduce or eliminate marking tool component misplacement and/or loss due to assembly and disassembly of the components.

Many specific details of certain embodiments are set forth in the following description and in FIGS. 1-11 to provide a thorough understanding of such embodiments. The present disclosure may have additional embodiments, or may be practiced without one or more of the details described below.

Figure 1:
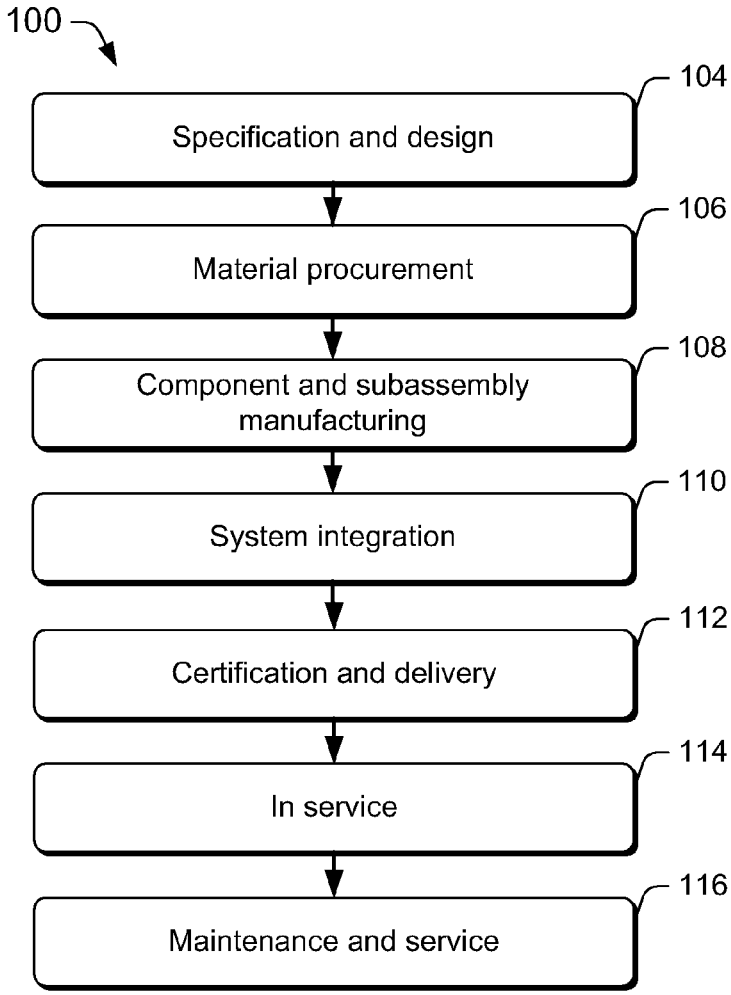
FIG. 1 is an illustration of a flow diagram of an aircraft manufacturing and service method that uses the various embodiments of the integral illuminated optical center finder and marking tool device.
Figure 2:
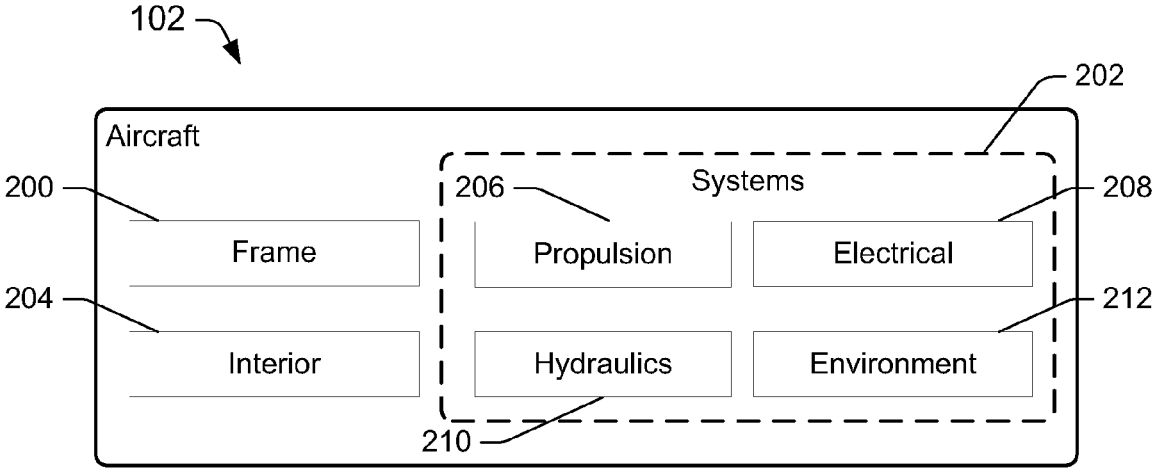
FIG. 2 is an illustration of a block diagram of an aircraft produced according to the manufacturing and service method described in FIG. 1.

Referring more particularly to the drawings, embodiments of this disclosure may be described in the context of an aircraft manufacturing and service method 100 as shown in FIG. 1, and an aircraft 102 as shown in FIG. 2. During pre-production, exemplary method 100 may include specification and design 104 of the aircraft 102 and material procurement 106. During production, component and subassembly manufacturing 108 and system integration 110 of the aircraft 102 takes place. Thereafter, the aircraft 102 may go through certification and delivery 112 in order to be placed in service 114. While in service, the aircraft 102 is scheduled for routine maintenance and service 116 (which may also include modification, reconfiguration, refurbishment, and so on). In various implementations, the embodiments may be used in at least one of the subassembly manufacturing 108, the system integration 110, the placement into service 114, and the routine maintenance and service 116.

Each of the processes of method 100 may be performed or carried out by a system integrator, a third party, and/or an operator (e.g., a customer). For the purposes of this description, a system integrator may include without limitation any number of aircraft manufacturers and major-system subcontractors; a third party may include without limitation any number of venders, subcontractors, and suppliers; and an operator may be an airline, leasing company, military entity, service organization, and so on.

As shown in FIG. 2, the aircraft 102 produced by exemplary method 100 may include an airframe 200 with a plurality of systems 202 and an interior 204. Examples of high-level systems include one or more of a propulsion system 206, an electrical system 208, a hydraulic system 210, and an environmental system 212. Any number of other systems may be included. Although an aerospace example is shown, the principles of this disclosure may be applied to other industries, such as the automotive industry.

Apparatuses and methods embodied herein may be employed during any one or more of the stages of the production and service method 100. For example, components or subassemblies corresponding to production process 108 may be fabricated or manufactured in a manner similar to components or subassemblies produced while the aircraft 102 is in service. Also, one or more apparatus embodiments, method embodiments, or a combination thereof may be utilized during the production stages 108 and 110, for example, by substantially expediting assembly of or reducing the cost of an aircraft 102. Similarly, one or more of apparatus embodiments, method embodiments, or a combination thereof may be utilized while the aircraft 102 is in service, for example and without limitation, to maintenance and service 116.

Figure 3A:
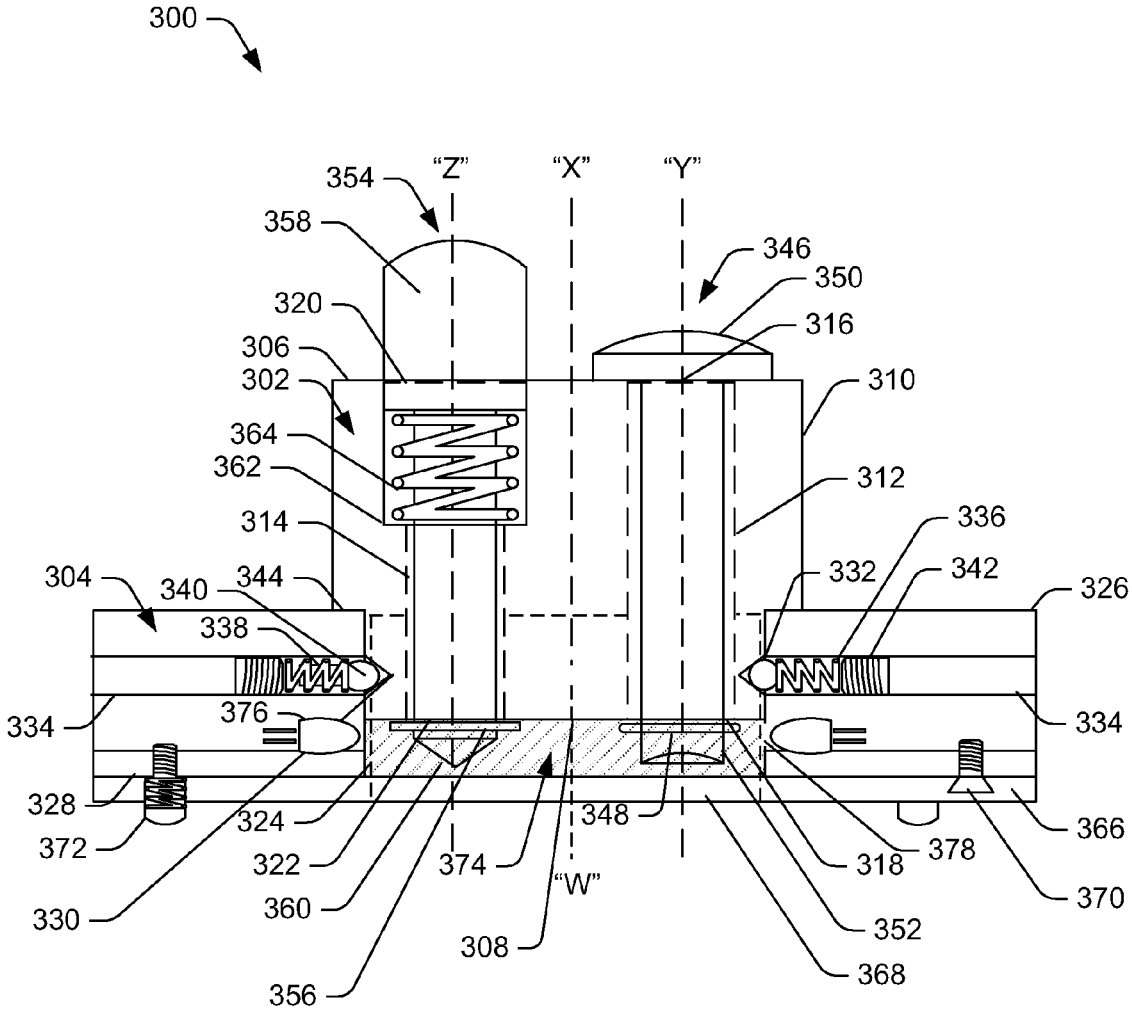
FIG. 3*a* is an illustration of a side view of an exemplary integral illuminated optical center finder and marking tool device, in accordance with various embodiments.

FIG. 3*a* is a side view of an exemplary integral illuminated optical center finder and marking tool device 300, in accordance with various embodiments. The exemplary integral illuminated optical center finder and marking tool device 300 may include a body 302 that is rotatably coupled to a base 304. Each of the body 302 and the base 304 may be manufactured from various metallic, composite, natural or hybrid materials, such as, but not limited to, steel, aluminum, wood, polymer, fiberglass, carbon-fiber reinforced plastic (CFRP), and the like.

The body 302 may include horizontal ends 306 and 308, and a vertical outer surface 310. The body 302 may further include at least two bore tunnels, such as bore tunnels 312 and 314, which are enclosed by and penetrate the body 302. In various embodiments, each of the bore tunnels 312 and 314 may penetrate the body 302 along an axis, such as an axis "Y" and an axis "Z", respectively, that parallels, or substantially parallels, a longitudinal axis "X" of the body 302. In other embodiments, the axis "Y" of the bore tunnel 312 and the axis "Z" may be perpendicular, or substantially perpendicular to at least one of the ends 306 and 308. In such embodiments, the axis "Y" of bore tunnel 312 and the axis "Z" of the bore tunnel 314 may be parallel, or substantially parallel to each other. In still other embodiments, the axis "Y" of the bore tunnel 312 and the axis "Z" may be both parallel, or substantially parallel, to the longitudinal axis "X" and perpendicular, or substantially perpendicular to at least one of the ends 306 and 308.

The bore tunnel 312 may form a first opening 316 at the end 306 of the body 302 and a second opening 318 at the end 308 of the body 302. In some embodiments, the cross sectional area of the opening 316 may be equal to, or substantially equal to, the cross sectional area of the opening 318. However, other embodiments, the cross sectional area of the opening 316 may be greater than or lesser than the cross sectional area of the opening 318.

In certain embodiments, the openings 316 and 318, and at least a portion of bore tunnel 312, may be circular, or substantially circular in cross section. In additional embodiments, the openings 316 and 318, and at least a portion of the bore tunnel 312, may be in the form of other geometric shapes in cross section (e.g., oval, rectangle, square, etc.).

Likewise, the bore tunnel 314 may form a first opening 320 at the end 306 of the body 302 and a second opening 322 at the end 308 of the body 302. In some embodiments, the cross sectional area of the circular opening 320 may be equal to, or substantially equal to, the cross sectional area of the opening 322. However, in other embodiments, the cross sectional area of the opening 320 may be greater than or less than the cross sectional area of the opening 322.

In certain embodiments, the openings 320 and 322, and at least a portion of bore tunnel 314, may be circular, or substantially circular in cross section. In additional embodiments, the openings 320 and 322, and at least a portion of the bore tunnel 314, may be in the form of other geometric shapes in cross section (e.g., oval, rectangle, square, etc.).

The base 304 may include a bore hole 324 that is enclosed by and penetrates the base 304 from the end 326 to the end 328. The bore tunnel 314 may include a longitudinal axis "W" that aligns with the "X" axis, or alternatively parallels or substantially parallels at least one of the axis "X" of the bore tunnel 312 or the axis "Y" of the bore tunnel 314. The bore hole 324 may be circular in cross section.

The body 302 may be removably retained in the bore hole 324 of the base 304. Moreover, the body 302 may be rotated in place, such as around the axis "X", with respect to the base 304. Accordingly, the body 302 may include a concentric groove 330 that runs along a portion of its outer surface 312. The concentric groove 330 may be positioned perpendicular, or substantially perpendicular, to the longitudinal axis "W" of the bore tunnel 314.

In turn, the base 304 may include one or more detents 332 that are configured to fit into one or more channels 334 that are also perpendicular, or substantially perpendicular to the axis "W". Each of the channels 334 may include an elastic member 336 (e.g., a spring) that urges a corresponding detent 332 into the concentric groove 330 of the body 302, so that a first portion of the corresponding detent 332 resides in concentric groove 330, and a second portion of the corresponding detent resides in its channel 334. In this way, the body 302 may be retained in the bore hole 324 of the base 304 by the one or more detent 332. In various embodiments, the one or more detents 332 may be ball bearings that freely rotate in any direction to reduce the friction between the body 302 and the base 304, thereby facilitating the rotation of the body 302 with respect to the base 304.

In other embodiments, each of the one or more detents 332 may be an elongated member 338 that fits inside its corresponding channel 334. The elongated member 338 may include an end 340 that is urged to protrude from the base 304 and against the concentric groove 330 of the body 302 by the elastic member 336. In various embodiments, the protruding end 340 of the elongated member 338 may be tapered to fit into the concentric groove 330 (e.g., semi-spherical taper, blunt taper, etc). In still other embodiments, the base 304 may include a combination of one or more ball bearing detents and one or more tapered detents.

Each of the one or more detents 332 and its corresponding elastic member 336 may be retained in their corresponding channel 334 by a retaining member 342. In some embodiments, the channels 334 of the body base 304 may be internally threaded, and the retaining member 342 may be a fastener (e.g., a set screw) that includes a mating thread. In this way, the retaining member 342 may be held to its channel 334. Moreover, the position of the retaining member 342 in its channel 334 may be adjusted to increase or decrease the tension on the corresponding elastic member 336, as well as enable the replacement of the corresponding elastic member 336 and/or the detent 332.

Nevertheless, it will be appreciated that in other embodiments, the retaining member 342 may be affixed to it channel 334 by other means, such as by the use of an adhesive, frictional tension, solder, and the like.

In some embodiments, the body 302 may be configured to include a shoulder portion 344, that is, a protrusion that enables the body 302 to rest on top of the base 304. The shoulder portion 344 may support the body 302 on the base 304 during use, as well as serve to align the concentric groove 330 of the body 302 with the one or more channels 334 to facilitate the installation and removal of one or more detents 332, one or more elastic member 336, and/or retaining members 342.

An optical center finder 346 maybe retained in the bore tunnel 312 of the body 302. The optical center finder 346 may be a translucent or semi-translucent member that is manufactured from acrylic, glass, plastic, and the like. The optical center finder 346 may include a work surface end 348 that is inscribed with a marking that denotes its absolute cross sectional center. The optical center finder 346 may also include a viewing end 350 that includes a magnification lens component. The translucent or semi-translucent nature of the optical center finder 346 enables it to conduct light, which facilitates visual observation through the optical center finder 346. The optical center finder 346 may be retained in the bore tunnel 312 in such a way that it does not contact a work piece surface when the base 304 is placed against the work piece surface.

In at least one embodiment, the optical center finder 346 may be frictionally retained in the bore tunnel 312. In other embodiments, at least a portion of the optical center finder 346 may be threaded (e.g., male thread), and at least a portion of the bore tunnel 312 may include a mating thread (e.g., female thread) that enables the optical center finder 346 to thread to the body 302.

In other embodiments, the optical center finder 346 may be held inside the bore tunnel 312 by a retaining ring 352. The retaining ring 352 may snap onto the work surface end 348 of the optical center finder 346 after it has passed through the bore tunnel 312. The retaining ring 352 may be fastened to the optical center by frictional tension. Such frictional tension may be generated by a difference in the size of the opening of the retaining ring 346 and the size of the work surface end 348, the elasticity of the retaining ring 352, and the like. Nevertheless, it will be appreciated that in other embodiments, the optical center finder 346 may be affixed to the bore tunnel 312 by other means, such as by the use of an adhesive, frictional tension, solder, and the like.

A marking tool 354 may be affixed inside the bore tunnel 314. In at least one embodiment, the marking tool 354 may be a center punch. In such an embodiment, the marking tool 354 may include a working end 356 for making impressions on a work surface, and an enlarged blunt end 358 for receiving impact force. The center punch may be movably retained inside the bore tunnel 314 by a combination of the enlarged blunt end 358 and a retaining collar 360.

In some embodiments, the retaining collar 360 may be fastened to the working end 356 of the marking tool 354 by frictional tension. Such frictional tension may be generated by a difference in the size of the opening of the retaining collar 360 and the size of the working end 356, the elasticity of the retaining collar 360, and the like.

In other embodiments, the working end 356 of the marking tool 354 may include a threaded portion, and the retaining collar 360 may include a mating thread portion that enables the retaining collar 360 to be removably affixed to the marking tool 354.

The bore tunnel 314 may be configured to accommodate at least a portion of the enlarged blunt end 358 of the marking tool 354 in further embodiments. Moreover, a portion of the bore tunnel 314 may be enlarged to form shoulder 362 for supporting the enlarged blunt end 358. In such embodiments, the area of the first opening 316 of the bore tunnel 314 may be larger than the second opening 318.

An elastic member 364 (e.g., spring) may be positioned to partially surround the length of the marking tool 354 and rest against the shoulder 362. The combination of the elastic member 364 and the marking tool 354 may be arranged on the shoulder 362 in such a way that the working end 356 of the marking tool 354 does not contact the work piece surface when the base 304 is placed against the work piece surface and no force is applied against the enlarged blunt end 358. Accordingly, the elastic member 364 may enable the marking tool 354 to return to an original position after an impact force has been applied at the enlarged blunt end 358 to drive the working end 356 to contact a work piece surface.

A friction pad 366 may be disposed on the base 304 so that it contacts a work piece surface when the base 304 is placed onto the surface. In various embodiments, the friction pad 366 has an outer boundary that follows the external perimeter of the base 304. Additionally, the friction pad may include an internal opening 368. The internal opening 368 may be sized so that the friction pad 366 does not obstruct the bore tunnels 312 and 314. The friction pad 366 may be configured to increase friction and reduce surface slippage between the base 304 and a work piece surface. In some embodiments, the friction pad 366 may be sufficiently elastic to also conform to non-flat work piece surfaces (e.g., a curved surface) while maintain friction between the base 304 and the non-flat work piece surface. Thus, the friction pad may be manufactured from cork, silicone, rubber, or other elastic materials. Moreover, the friction pad 366 may be provided with ridges and/or grooves to further increase frictional gain.

In various embodiments, the friction pad 366 may be affixed to the base 304 via one or more fasteners 370 (e.g., a screw). However, in other embodiments, the friction pad 366 may be affixed to the base 304 via an adhesive, or a combination of one or more fasteners 370 and adhesive.

In other embodiments, one or more conformable feet 372 may be disposed on the base 304. The one or more conformable feet 372 may serve to increase friction and reduce surface slippage between the base 304 and the work piece surface. Additionally, the one or more conformable feet 372 may also enable the base 304 to conform to non-flat work piece surfaces (e.g., a curved surface). In such embodiments, each of the one or more conformable feet 372 may include an elastic member (e.g., a spring), that enables each conformable feet 372 to independently vary its length with respect to the base 304.

In other embodiments, the one or more conformable feet 372 may be manufactured from rubber, silicone, or other elastic materials. Moreover, the one or more conformable feet 372 may be provided with ridges and/or grooves to further increase friction gain. In still other embodiments, a combination of elastic member-equipped and elastic material conformable feet 372 may be disposed on the base 304. Further, each of the one or more conformable feet 372 may be affixed to the base 304 in the same manner as the friction pad 366 (e.g., via one or more fasteners and/or adhesive).

The body 302 and the base 304 may be coupled together in such a way so that a cavity 374 may be formed under the body 302 when the base 304 is brought into contact with a work piece surface. Accordingly, the base 304 may include one or more light sources 376 (e.g., light emitting diodes) that illuminate the cavity 374. Such illumination may facilitate the location of pre-designated positions on the work piece surface, through the optical center finder 346, such as locations indicated by scribe marks, fasteners, etc. For example, such illumination may be used to locate the pre-designated positions in less than ideal lighting conditions.

In various embodiments, the one or more light sources 376 may be integrally housed in the base 304. The base 304 may include portals 378 that enable illumination from the one or more light sources 376 to pass directly into the cavity 374. In other embodiments, the base 304 may be embedded with translucent and/or reflective light passageways (e.g., clear acrylic, fiber optics, etc.) that convey the illumination from the one or more light sources 376 to the cavity 374. In such embodiments, the base 304 may additionally house a power source (e.g., batteries), wires, circuitry and/or one or more switches needed to turn on and off the one or more light sources 376. In at least one embodiment, the power source may be housed in a compartment of the base 304 that includes a removable cover. The one or more switches for achieving the operations of one or more light sources 376 are described below with respect to FIG. 3*b*.

Figure 3B:
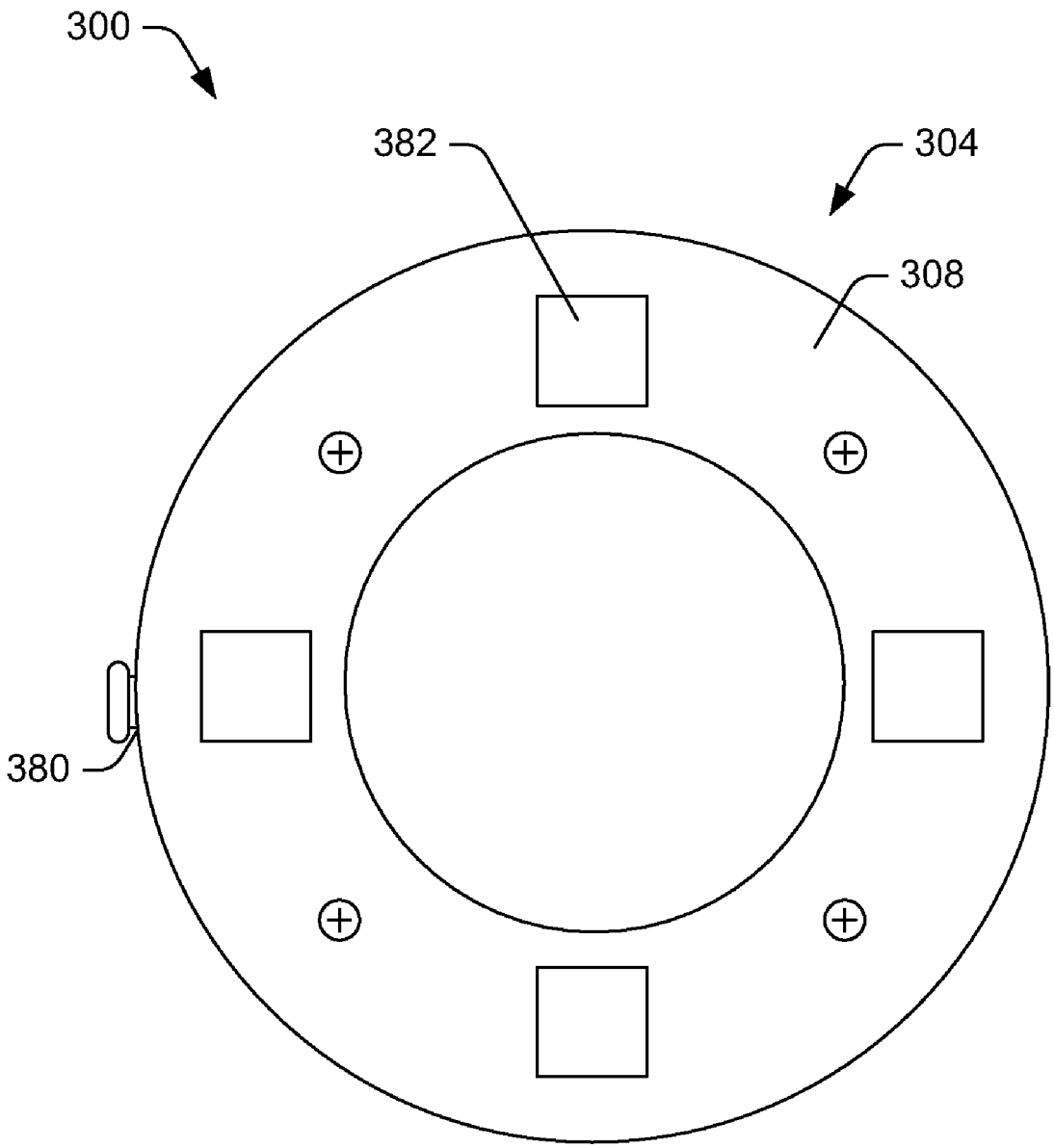
FIG. 3*b* is an illustration of a bottom view of the exemplary integral illuminated optical center finder and marking tool device illustrated in FIG. 3*a*, in accordance with various embodiments.

FIG. 3*b* is a bottom view of the exemplary integral illuminated optical center finder and marking tool device illustrated in FIG. 3*a*, in accordance with various embodiments. As shown, a manual switch 380 for activating/deactivating the one or more light sources 376 may be disposed on the side of the base 304. In some embodiments, the manual switch 380 may be a push-button switch, or an equivalent on/off switch. In other embodiments, the manual switch 380 may be an incremental switch that gradually increases or decreases the intensity of the illumination, or a multi-stage switch that increases or decreases the intensity of the illumination in a plurality of stages.

In additional embodiments, the body 304 may include one or more contact switches 382 (e.g., rubber membrane switches) that are disposed at its work piece contact end 308. The one or more contact switches 382 may protrude from the end 308 while in an off position. Accordingly, each of the contact switches 382 may be activated when the body 304 is pressed against a work piece surface so that the switch no longer protrudes from end 308 of the body 304. In some embodiments, the activation of at least one contact switch may complete a circuit between the power source and the one or more light sources 376. In such embodiments, the deactivation of the same contact switch, (e.g., by removing the body 304 from the work piece surface) may interrupt the circuit to deactivate the one or more light sources 376.

In other embodiments, the completion of a circuit between the power source and the one or more light sources 376 may be achieved when each of the one or more contact switches 382 is pressed against the work piece surface. Conversely, the deactivation of a single contact switch 382 may interrupt the circuit between the power source and the one or more light sources 376.

In still other embodiments, the body 304 may include both a manual switch 380 and one or more contact switches 382 that operate in conjunction with a circuitry. In such embodiments, the manual switch 380 may function as a master on/off switch that controls the overall disbursement of power from the power source (e.g., power on, power off), and the one or more contact switches 382 may serve to complete a circuit between the power source and the one or more light sources 376. In embodiments where the body 304 is provided with a friction pad 366, the friction pad 366 may be provided with openings to accommodate the contact switches 382 so that the contact switches 382 may contact a work piece surface.

Figure 3C:
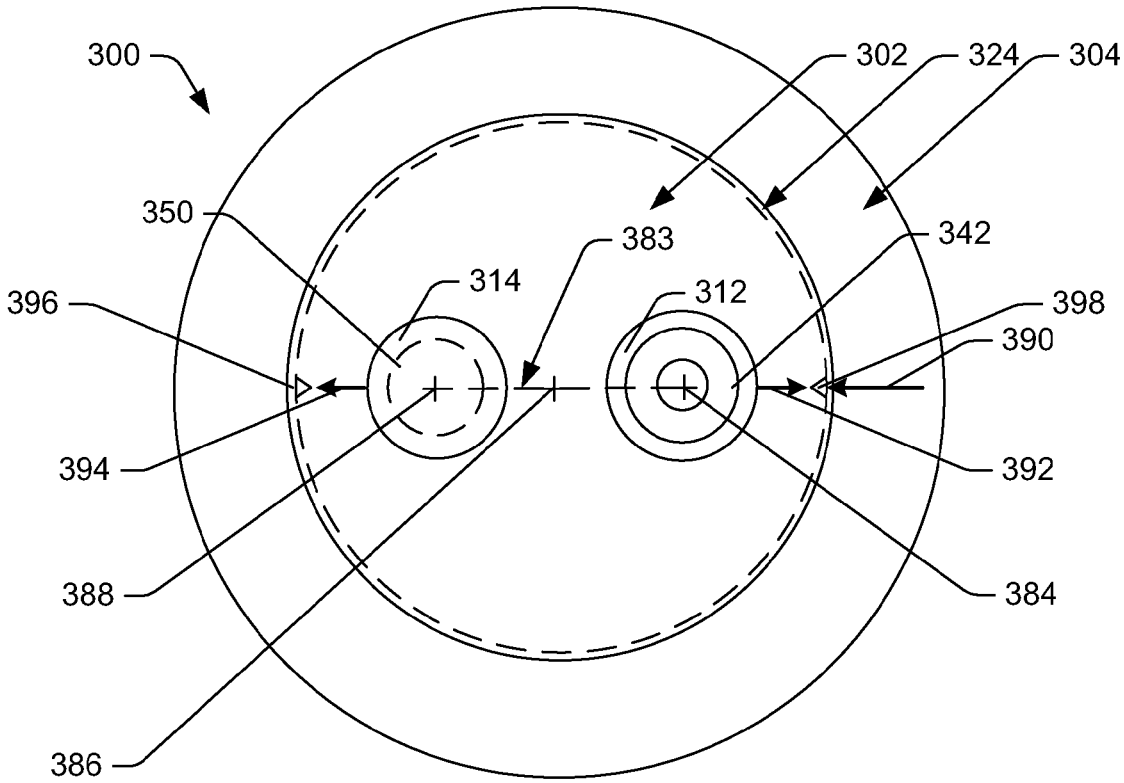
FIG. 3*c* is an illustration of a top view of an exemplary integral illuminated optical center finder and marking tool device illustrated in FIG. 3*a*, in accordance with various embodiments.

FIG. 3*c* is a top view of an exemplary integral illuminated optical center finder and marking tool device illustrated in FIG. 3*a*, in accordance with various embodiments. FIG. 3*c* shows the body 302 and the base 304. As shown, at least a portion of the body 302 may be circular in cross section so that it may be accommodated in the circular bore hole 324 of the base 304.

As describe above, the body 302 is provided with at least two bore tunnels 312 and 314. The bore tunnels 312 and 314 may be arranged in a 180° degree opposed configuration. In other words, the bore tunnels 312 and 314 may be arranged so that an imagery line 383 may extend from the absolute center 384 of the bore tunnel 312 to the absolute center 386 of the body 302, and then to the absolute center 388 of the bore tunnel 312. Moreover, the absolute center 384 of the bore tunnel 312 and the absolute center 388 of the bore tunnel 314 may be of equal distance from the absolute center 386 of the body 302. In this way, when the body 302 is rotated (e.g., clockwise or counter-clockwise) with respect to the base 304, the absolute center 384 of the bore tunnel 312 may be brought into alignment with a location previously occupied by the absolute center 388 of the bore tunnel 314, and vice versa.

As described above, the bore tunnel 312 may be configured to accommodate the optical center finder 346, and the bore tunnel 314 may be configured to accommodate the marking tool 354. Thus, the ability to rotate the body 302 so that the absolute center 388 may be brought into alignment with a location previously occupied by the absolute center 384 may enable the use of the marking tool 354 to mark a target spot ascertained using the optical center finder 346.

It will be appreciated that in other embodiments, the bore tunnels 312 and 314 may be arranged in other angular configurations so long as the absolute center 384 of the bore tunnel 312 and the absolute center 388 of the bore tunnel 314 are of equal distance from the absolute center 386 of the body 302. In such embodiments, the rotation of the body 302 with respect to the base 304 may bring the absolute center 384 into alignment with the absolute center 388 in a plane that is perpendicular, or substantially perpendicular to the axis "X" (FIG. 3*a*) of the body 302, thereby ensuring the marking of a target spot located via the optical center finder 346.

The body 302 and the base 304 may be provided with corresponding alignment markings that aid in the rotation of body 302 so that the absolute center 384 of the bore tunnel 312 aligns with the absolute center 388 of the bore tunnel 314. For example, the base 304 may be provided with a line marking 390, and the body 302 may be provided with a line marking 392 that is on a path that aligns with the absolute center 388 of the bore tunnel 314 and the absolute center 386 of the bore tunnel 314. The line marking 390 may be configured to align with the line marking 392 to form a straight line. Further, the body 302 may be provided with a line marking 394 that is on a path that aligns with the absolute center 384 of the bore tunnel 312 and the absolute center 386 of the bore tunnel 314.

In this way, a location corresponding to the absolute center 388 of the bore tunnel 314 when the lines marking 390 and 392 are aligned may be made to correspond to the absolute center 384 of the bore tunnel 312 when the line markings 390 and 394 are aligned via the rotation of the body 302. It will be appreciated that the various line markings may be made on the body 302 and the base 304 via printing and/or engraving, and the like.

In some embodiments, the concentric groove 330 of the body 302 may be provided with notches, such as notches 396 and 398, which are a greater depth than a depth of the concentric groove 330. The notches 396 and 398 may be positioned on the body 302 in the same positions as the line markings 392 and 394, respectively. In such embodiments, the action of the one or more detents 332 traveling into and out of the notches 396 and 398 from the concentric groove 330 may serve to temporarily "lock" the body 302 into rotational positions that facilitate the alignment of the absolute center 384 and the absolute center 386. Additionally, the notches 396 and 398 may provide tactile feedback to inform an operator of such alignments. It will be appreciated that the notches 396 and 398 and the lines markings 390, 392, and 394 may be provided in combination or independently in different embodiments (e.g., notches only, line markings only, notches and line markings).

Figure 4A:
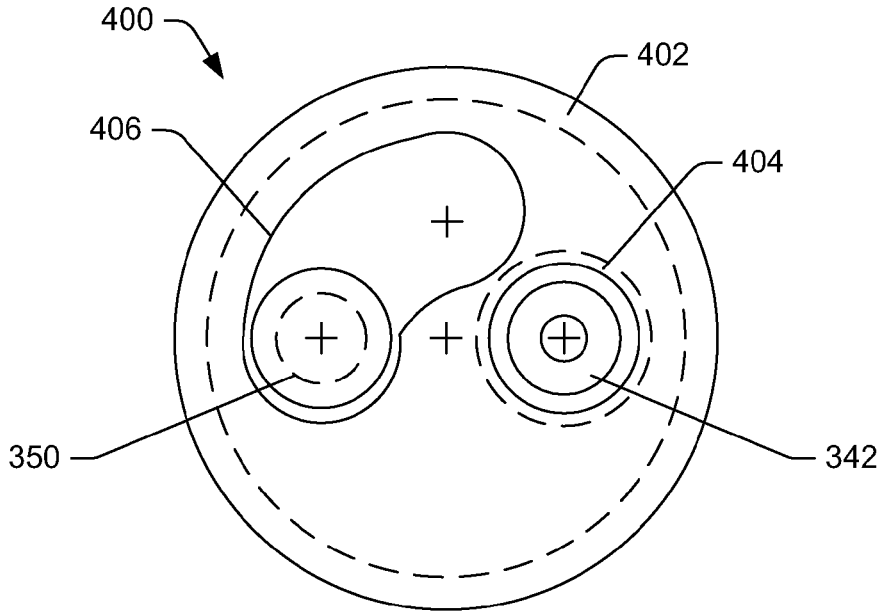
FIG. 4*a* is an illustration of a top view of an exemplary integral illuminated optical center finder and marking tool device that includes a protective cap, in accordance with various embodiments.

FIG. 4*a* is a top view of an exemplary integral illuminated optical center finder and marking tool 400 that includes a protective cap 402, in accordance with various embodiments. The protective cap 402 may be circular in cross section. The protective cap 402 may be disposed on the horizontal end 306 of the body 304 when the horizontal end 306 also has a circular in cross section that accommodates the protective cap 402. The protective cap 402 may include a first opening 404 that aligns with a first bore tunnel, such as the bore tunnel 312, and a second opening 406 that provides access to a second bore tunnel, such as the bore tunnel 314. In various embodiments, the openings 404 and 406 of the protective cap 402 may be configured so that when the protective cape 402 is rotated with respect to the body 302, the protective cap 402 may cover the first bore tunnel while the second bore tunnel remains uncovered. In at least one embodiment, such selective coverage of the bore tunnels may be achieve by enlarging one of the openings, such as the second opening 406.

In embodiments where the optical center finder 346 is disposed in the bore tunnel 312 and a marking tool 354 (e.g., center punch) is disposed in the bore tunnel opening 314, the protective cap 402 may be rotated so that the optical center finder 346 is transformed from being uncovered to covered, while the marking tool 354 remains uncovered. Thus, the protective cap 402 may shield the optical center finder 346 from accidental impact while the marking tool 354 is struck with an impact force. Accordingly, the protective cap 402 may be manufactured from a durable material. The durable material may be one of a metallic, composite, or hybrid material, such as, but not limited to, steel, aluminum, impact-resistant polymer, carbon-fiber reinforced plastic (CFRP), and the like. In some embodiments, the durable material may be further covered with an elastic material, such as a rubber coating, to absorb impact and/or protect the durable material.

Figure 4B:
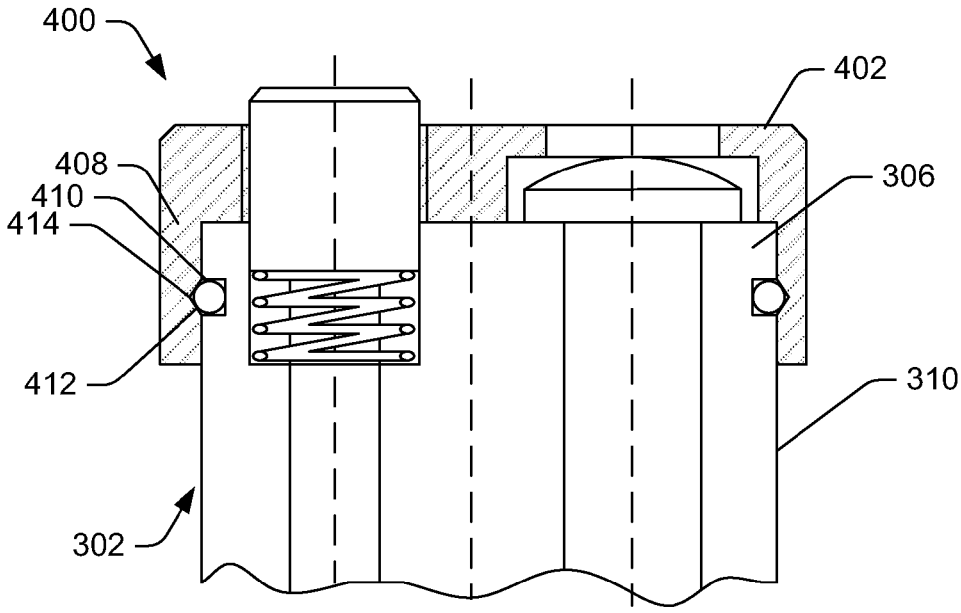
FIG. 4*b* is an illustration of a side view of an exemplary integral illuminated optical center finder and marking tool device that includes a protective cap, in accordance with various embodiments.

FIG. 4*b* is a side view of an exemplary integral illuminated optical center finder and marking tool 400 that includes a protective cap 402, in accordance with various embodiments. Once again, the protective cap 402 may be disposed on the horizontal end 306 of the body 304. The protective cap 402 may include a sidewall 408 that envelopes at least a portion of the vertical outer surface 310 of the body 302. In various embodiments, the vertical outer surface 310 of the body 304 may be provided with a concentric indentation 410 that partially accommodates an elastic o-ring 412. In turn, sidewall 408 may also include a matching concentric indentation 414 that also partially accommodates the o-ring 412. The o-ring 412 may be manufactured from an elastic material, such as, without limitation, rubber, silicone, etc. In this way, the o-ring 412 may enable the protective cap 402 to be removably held to the body 304 and freely rotate with respect to the body 304.

Figure 5:
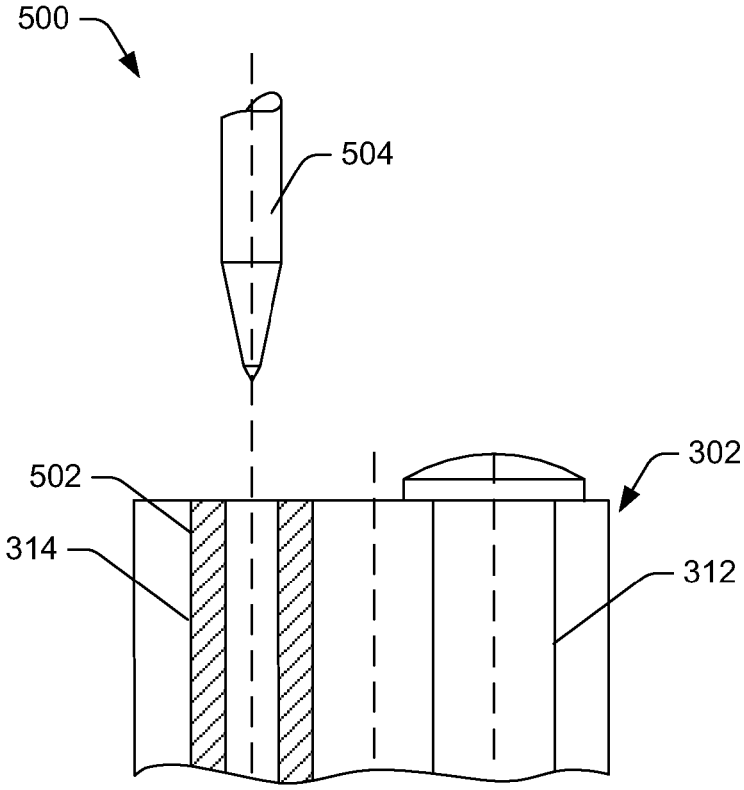
FIG. 5 is an illustration of a side view of an exemplary integral illuminated optical center finder and marking tool device that includes an automatic center punch, in accordance with various embodiments.

FIG. 5 is a side view of an exemplary integral illuminated optical center finder and marking tool device 500 that includes an automatic center punch, in accordance with various embodiments. The exemplary integral illuminated optical center finder and marking tool device 500 may include the body 302 and the base 304 illustrated in FIGS. 3-4, which may possess one or more of the features described in the various embodiments of FIG. 3-4. For example, the body 302 may include bore tunnels 312 and 314. The bore tunnel 312 may accommodate an optical center finder 346.

Additionally, the bore tunnel 314 may include a mechanical bushing 502 that is configured to flexibly grip a mechanical device that is inserted into the bore tunnel 314. In various embodiments, the mechanical bushing 502 may be configured to accommodate an automatic center punch 504. In operation, the mechanical bushing 502 may enable the automatic center punch to be pushed down into contact with a work piece surface to leave a marking, and then retract away from the work piece surface.

Figure 6:
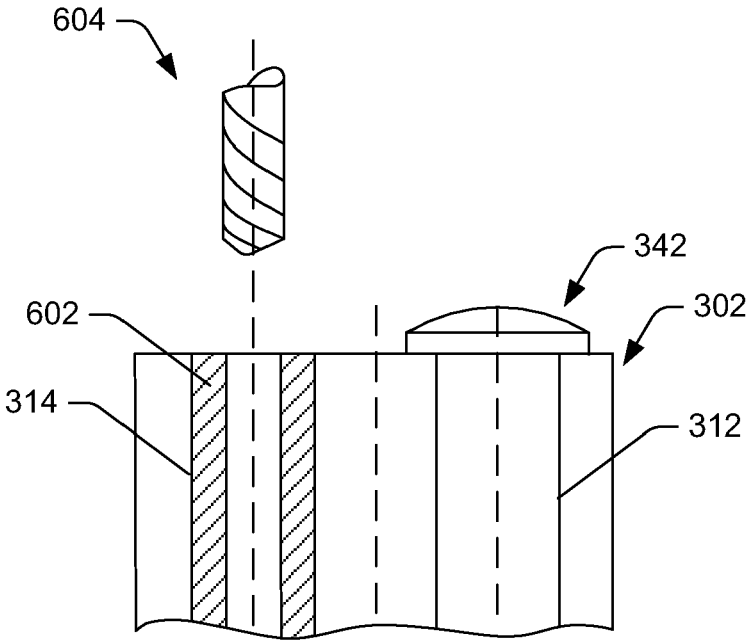
FIG. 6 is an illustration of a side view of an exemplary integral illuminated optical center finder and marking tool device that includes a drill bushing, in accordance with various embodiments.

FIG. 6 is a side view of an exemplary integral illuminated optical center finder and marking tool device that includes a drill bushing, in accordance with various embodiments. The exemplary integral illuminated optical center finder and marking tool device may include the body 302 illustrated in FIGS. 3-4, which may possess one or more of the features described in the various embodiments of FIGS. 3-4. For example, the body 302 may include bore tunnels 312 and 314. The bore tunnel 312 may accommodate an optical center finder 346.

Additionally, the bore tunnel 314 includes a drilling bushing 602 that is configured to reduce friction when a drill bit 604 is inserted into the bore tunnel 314. In various embodiments, the drill bushing 602 may be configured to accommodate a drill bit 604. In operation, the drilling bushing 602 may enable a drill bit to be pushed down into contact with a work piece surface to penetrate the work piece surface or the entire work piece, and then retract away from the work piece surface.

In at least one embodiment, the exemplary integral illuminated optical center finder and marking tool may be used to mark a center of a fastener that is installed on the work piece surface. In such an embodiment, the optical center finder 346 may be used to locate the center of a head of the installed fastener. The body 302 may then be rotated to center the drilling bushing 602 at the location previously occupied by the optical center finder 346. In this way, the drilling bushing 602 may serve to guide the drill bit 604 as it penetrates the head of the installed fastener and subsequently retracts from the installed fastener.

Figure 7:
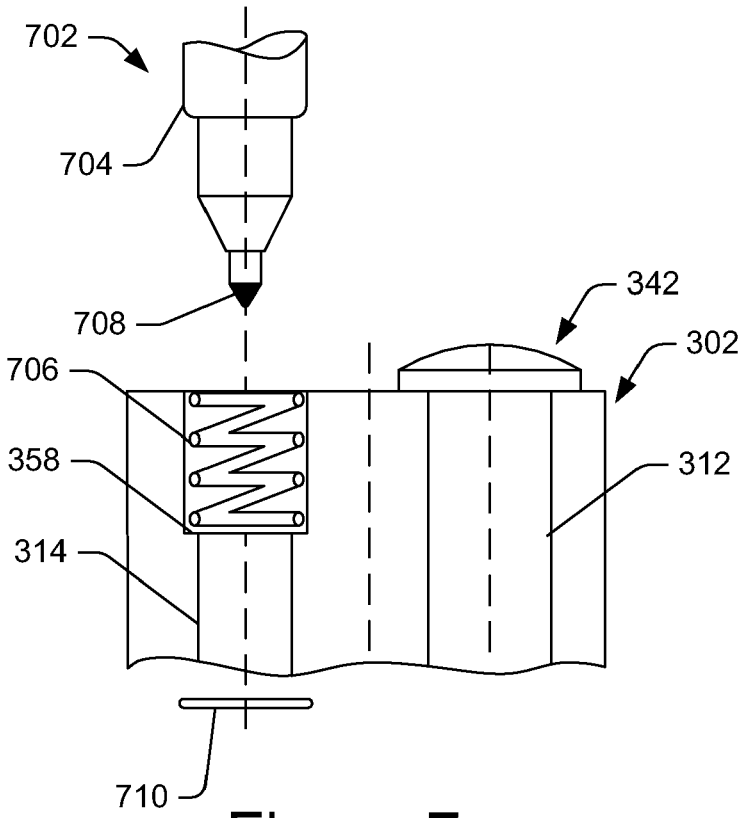
FIG. 7 is an illustration of a side view of an exemplary integral illuminated optical center finder and marking tool device that includes a non-penetrative marking tool, in accordance with various embodiments.

FIG. 7 is a side view of an exemplary integral illuminated optical center finder and marking tool device that includes a non-penetrative marking tool, in accordance with various embodiments. The exemplary integral illuminated optical center finder and marking tool device may include the body 302 illustrated in FIGS. 3-4, which may possess one or more of the features described in the various embodiments of FIGS. 3-4. For example, the body 302 may include bore tunnels 312 and 314. The bore tunnel 312 may accommodate an optical center finder 346. The bore tunnel 314 may include a non-penetrating marking tool 702, such as a felt tip marker, a grease pencil, a lead pencil, etc.

The bore tunnel 314 may be configured to accommodate at least a portion of the body 704 of the non-penetrating marking tool 702. Moreover, as previously described, a portion of the bore tunnel 314 may be enlarged to form shoulder 362. In such embodiments, the area of the first opening 320 of the bore tunnel 314 may be larger than the second opening 322.

An elastic member 706 (e.g., spring) may be positioned to partially surround the length of the marking tool 702 and rest against the shoulder 362. The combination of the elastic member 364 and the non-penetrating marking tool 702 may be arranged on the shoulder 362 in such a way that the marking end 708 of the non-penetrating marking tool 702 does not contact the work piece surface when the base 304 is placed against the work piece surface and no force is applied against the enlarged blunt end 358.

Accordingly, the elastic member 364 may enable the non-penetrating marking tool 702 to return to an original position after the tool 702 has been pressed down to contact and mark a work piece surface. In some embodiments, a retaining ring 710 may be fastened to the marking end 708 of the non-penetrating marking tool 702 after the tool 702 has been inserted through the bore tunnel 314, where the retaining ring 710 functions in the same manner as the exemplary retaining ring 352 (FIG. 3).

Figure 8:
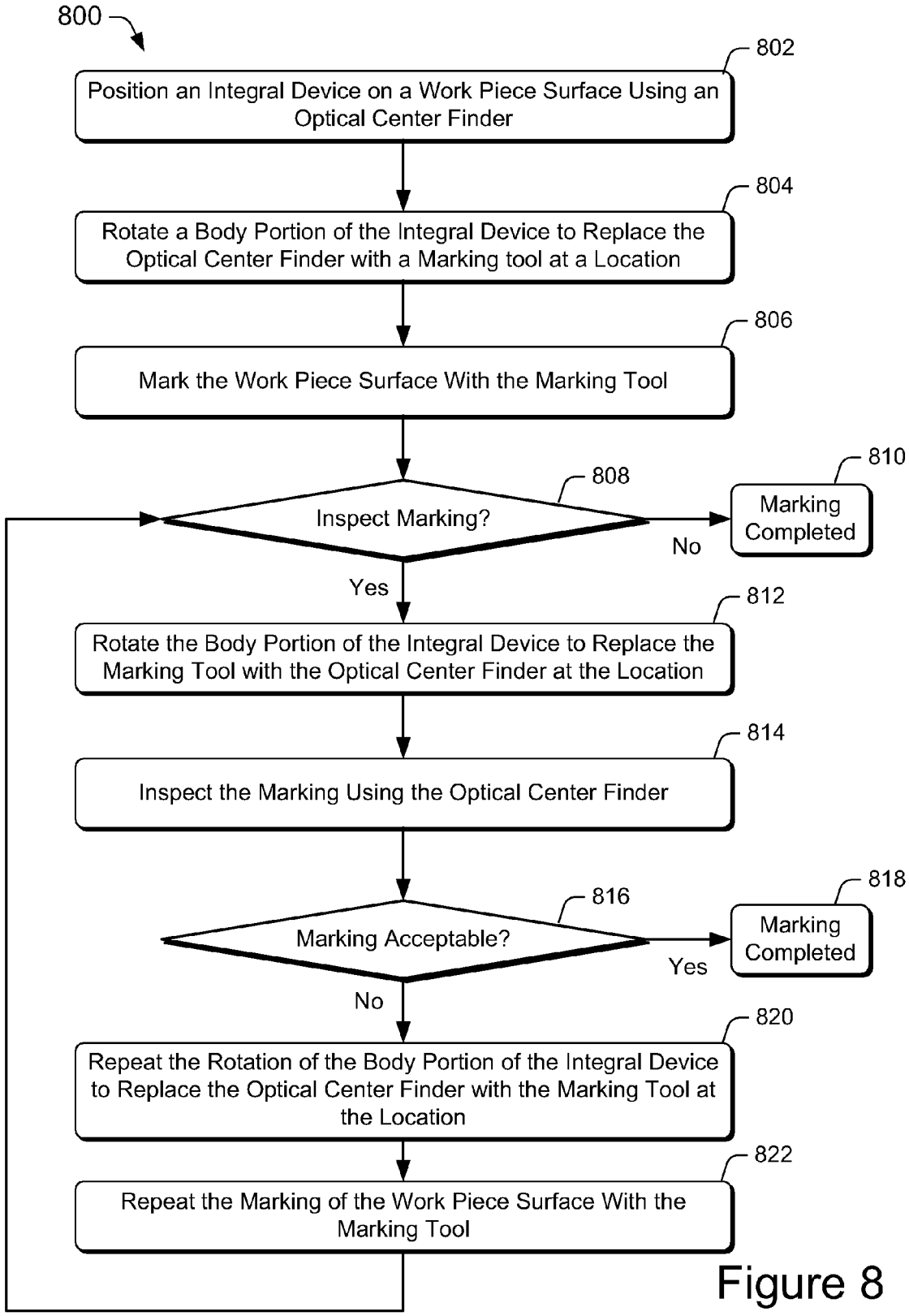
FIG. 8 is an illustration of a flow diagram illustrating a first exemplary process for using the exemplary embodiments of the Integral illuminated optical center finder and marking tool shown in FIGS. 3-7, in accordance with various embodiments.

FIG. 8 is a flow diagram illustrating an exemplary process 800 for using the exemplary embodiments of the Integral illuminated optical center finder and marking tool shown in FIGS. 3-7, in accordance with various embodiments The order in which the operations are described in the process 800 is not intended to be construed as a limitation, and any number of the described blocks can be combined in any order and/or in parallel to implement the process.

At block 802, an integral illuminated optical center finder and marking tool that includes one or more features described in FIGS. 3-7 (herein after referred in FIG. 8 to as the "integral device"), may be positioned at a particular location on a work piece surface. The integral device may include the body 302, and the base 304. In various embodiments, an operator may place and hold the integral device onto the work piece surface in near proximity to a desired location. The operator may subsequently maneuver the integral device to the desired location on the work piece surface via the use of an optical center finder, such as the optical center finder 346. The operator may maneuver the integral device to the location by centering the optical center finder 346 on one or more visual features on the work piece surface (e.g., one or more scribed lines, one or more scribed dots, one or more previously installed fasteners, etc). The optical center finder 346 may serve to magnify the visual features on the work piece surface.

In some embodiments, the placement of the integral device on the work piece surface may automatically activate one or more light sources, such as the one or more light sources 376, built into the integral device. The one or more light sources 376 may aid the operator in locating the one or more visual features using the optical center finder 346. In other embodiments, the one or more light sources 376 may be manually activated by the operator for locating the one or more visual features.

At block 804, the operator may rotate the body portion 302 of the integral device with respect to the base 304 so that the optical center finder 346 is replaced with a marking tool, such as the marking tool 354. In various embodiments, the replacement of the optical center finder 346 with the marking tool 354 may position the center of the marking tool 354 (and/or a portion of marking tool 354 configured to contact the work piece surface) at the location ascertain by the optical center finder 346.

At block 806, the operator may mark the work piece surface with the marking tool 354. In various embodiments, the mark tool 354 may be a penetrative marking tool (e.g., center punch, an automatic center punch, drill bit, etc.) or a non-penetrative marking tool (e.g., felt-tip marker, grease pencil, lead pencil, etc.). In embodiments where the body 302 includes a protective cap, such as the protective cap 402, the protective cap 402 may be rotated to cover the optical center finder 346 prior to the use of the marking tool 354 to mark the work piece surface by the operator.

At decision block 808, the operator may determine whether the marking made by the marking tool 354 should be inspected. If the operator determines that the inspection of the marking is not needed ("no" at decision block 808), the particular marking of the work piece surface may be deemed completed and the process 800 may terminate at block 810. However, if the operator determines that inspection of the marking made by the marking tool 354 is needed ("yes" at decision block 808), the process 800 may proceed to block 812.

At block 812, the operator may rotate the body portion 302 of the integral device with respect to the base 304 so that the marking tool 354 is replaced with the optical center finder 346 at the location marked by the marking tool 354.

At block 814, the operator may visually inspect the marking created with the marking tool 354 via the optical center finder 346. In embodiments where the body 302 includes a protective cap 402, the operator may manipulate the protection cap 402 to expose the optical center finder 346 prior to making the visual inspection.

At decision block 816, the operator may determine whether the marking created with the marking tool 354 is acceptable (e.g., of sufficient clarity, depth, size, etc.) If the operator determines that marking is acceptable ("yes" at decision block 816), the operator may deem the particular marking of the work piece may be deemed completed and process 800 may be terminate at block 818. However, if the operator determines that the marking is not acceptable ("no" at decision block 816), the process 800 may proceed to block 820.

At block 820, the operator may repeat the rotation of the body portion 302 of the integral device with respect to the base 304 so that the optical center finder 346 is replaced with the marking tool 354.

At block 822, the operator may repeat the marking of the work piece surface with the marking tool 354. In embodiments where the body 302 includes a protective cap 402, the protective cap 402 may be once again rotated to cover the optical center finder 346 prior to the use of the marking tool 354 to mark the work piece surface by the operator. Following block 822, the process 800 may loop back to block 808, where the operator may determine whether the marking should be re-inspected. In this way, blocks 808-822 may be repeated until the marking process is completed.

Figure 9:
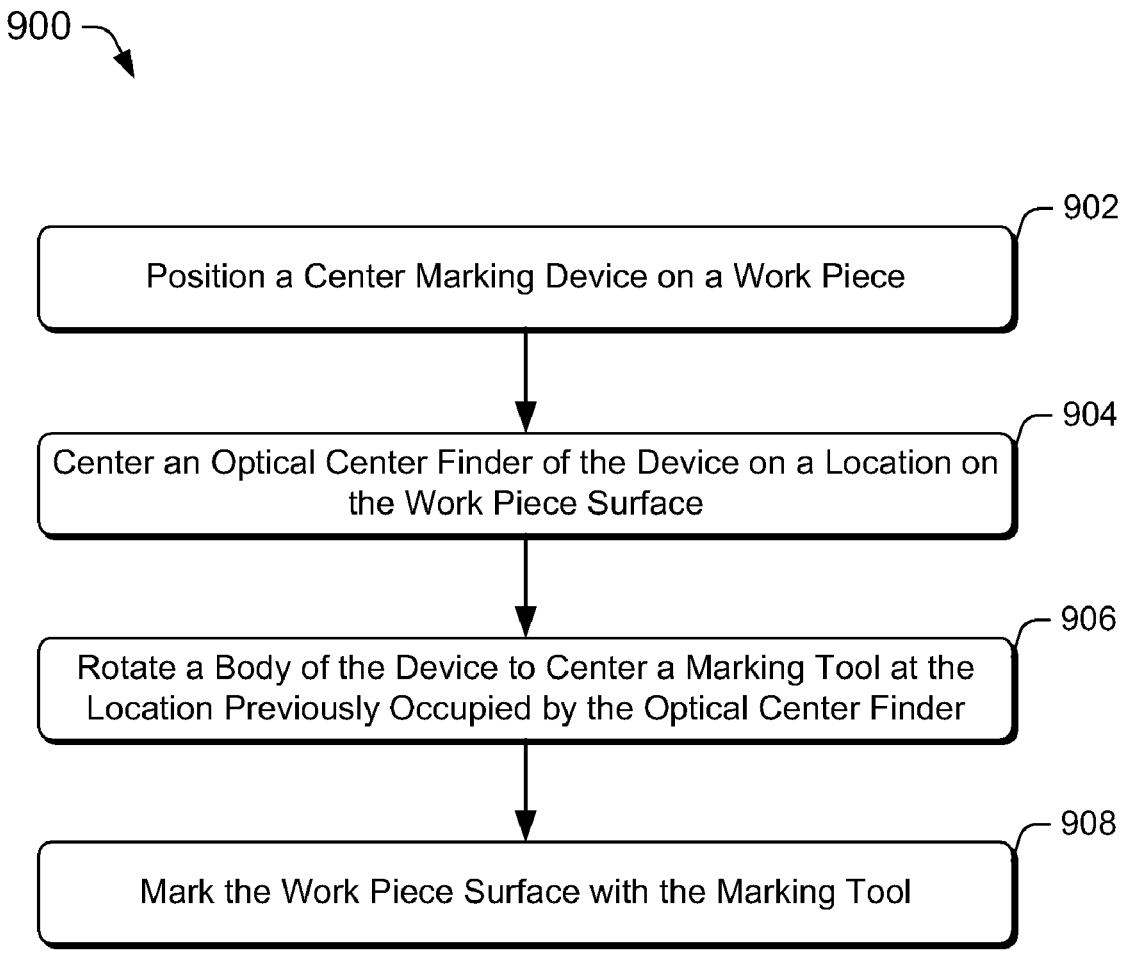
FIG. 9 is an illustration of a flow diagram illustrating a second exemplary process for using the exemplary embodiments of the Integral illuminated optical center finder and marking tool shown in FIGS. 3-7, in accordance with various embodiments.

FIG. 9 is a flow diagram illustrating an exemplary process 900 for using the exemplary embodiments of the Integral illuminated optical center finder and marking tool shown in FIGS. 3-7, in accordance with various embodiments. The order in which the operations are described in the process 900 is not intended to be construed as a limitation, and any number of the described blocks can be combined in any order and/or in parallel to implement the process.

At block 902, an Integral illuminated optical center finder and marking tool that includes one or more features described in FIGS. 3-7 (herein after referred in FIG. 9 to as the "center marking device"), may be positioned on a work piece. The center marking device may include the body 302, and the base 304.

In some embodiments, the placement of the center marking device on the work piece surface may automatically activate one or more light sources, such as the one or more light sources 376, built into the center marking device. The one or more light sources 376 may aid the operator in locating the one or more visual features using the optical center finder 346. In other embodiments, the one or more light sources 376 may be manually activated by the operator for locating the one or more visual features.

At block 904, an operator may center an optical center finder of the center marking device, such as the optical enter finder 346, on a location on a surface of the work piece. In various embodiments, the operator may place and hold the center marking device onto the work piece surface in near proximity to the location. The operator may subsequently maneuver the center marking device to the location on the work piece surface via the use of the optical center finder 346. The operator may maneuver the center marking device to the location by centering the optical center finder 346 on one or more visual features on the work piece surface (e.g., one or more scribed lines, one or more scribed dots, one or more previously installed fasteners, etc). The optical center finder 346 may serve to magnify the visual features on the work piece surface.

At block 906, the operator may rotate the body portion 302 of the center marking device with respect to the base 304 to center a mark tool, such as the marking 354, at the location previously occupied by the optical center finder.

At block 908, the operator may mark the work piece surface with the marking tool 354. In various embodiments, the mark tool 354 may be a penetrative marking tool (e.g., center punch, an automatic center punch, drill bit, etc.) or a non-penetrative marking tool (e.g., felt-tip marker, grease pencil, lead pencil, etc.). In embodiments where the body 302 includes a protective cap, such as the protective cap 402, the protective cap 402 may be rotated to cover the optical center finder 346 prior to the use of the marking tool 354 to mark the work piece surface by the operator.

Figure 10:
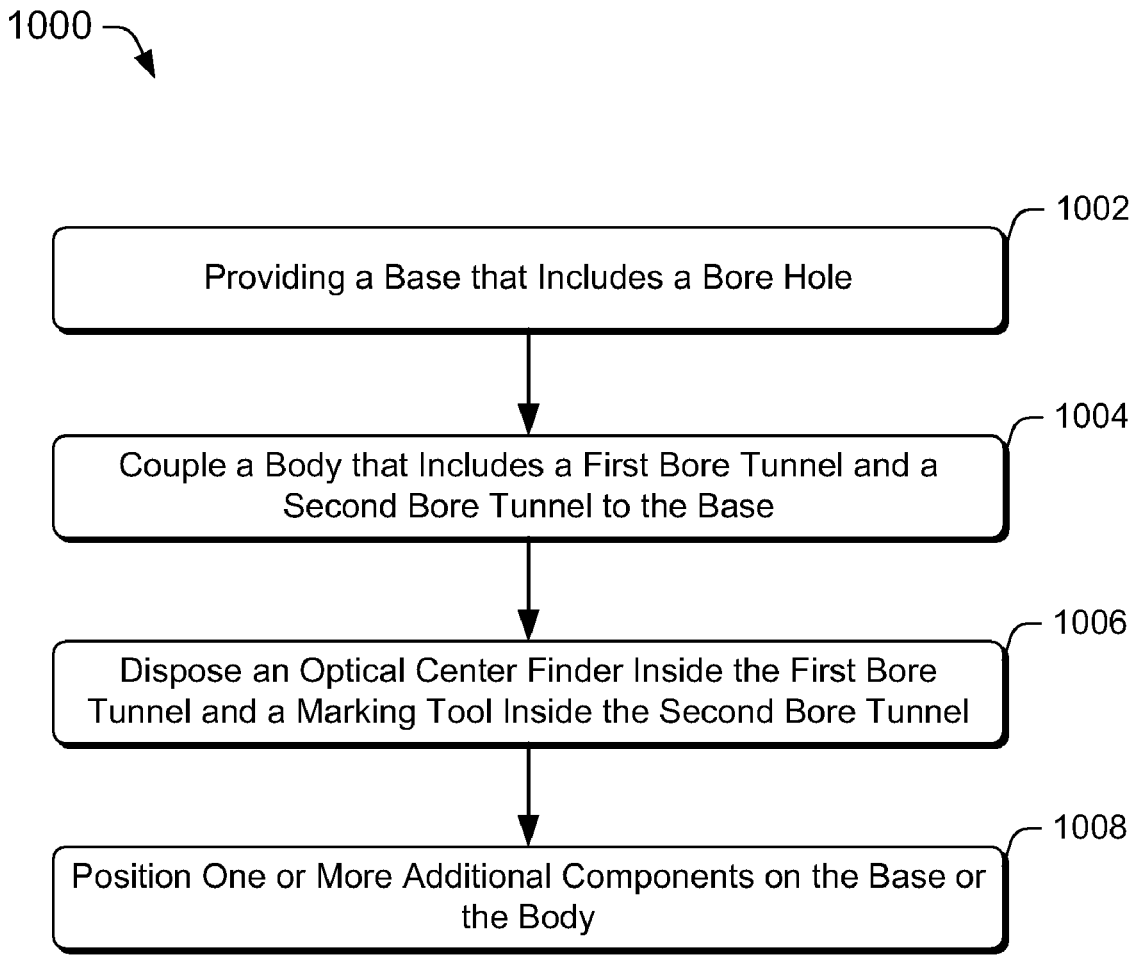
FIG. 10 is an illustration of a flow diagram illustrating an exemplary process for assembling an exemplary integral illuminated optical center finder and marking tool shown in FIGS. 3-7, in accordance with various embodiments.

FIG. 10 is a flow diagram illustrating an exemplary process 1000 for assembling an exemplary integral illuminated optical center finder and marking tool shown in FIGS. 3-7, in accordance with various embodiments. The order in which the operations are described in the process 1000 is not intended to be construed as a limitation, and any number of the described blocks can be combined in any order and/or in parallel to implement the process.

At block 1002, a base that includes a bore hole, such as the base 302, may be provided.

At block 1004, the base may be coupled to a body that include a first bore tunnel and a second bore tunnel, such as the body 304 that includes a bore tunnel 312 and a bore tunnel 314.

At block 1006, an optical center finder, such as the optical center finder 346, may be disposed in the first bore tunnel, while a marking tool, such as the marking tool 354, may be disposed inside the second bore tunnel.

At block 1008, one or more additional components may be positioned on the body or the base. In various embodiments, these one or more components may include, but are not limited to, the friction pad 366, the protective cap 402, the o-ring 412, the light source 376, the manual switch 380, the one or more contact switches 382 and associated power source and circuitry, and/or the one or more conformable feet 372.

Figure 11:
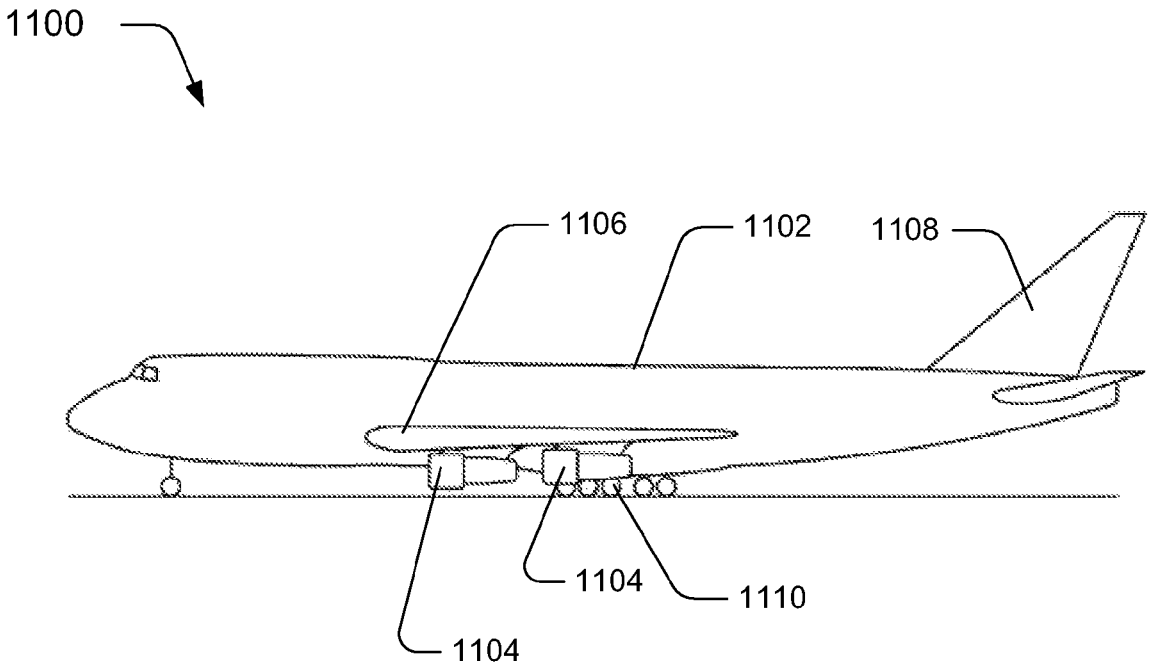
FIG. 11 is an illustration of a side elevational view of an aircraft that includes components that are assembled or manufactured using the various embodiments of the exemplary integral illuminated optical center finder and marking tools.

FIG. 11 is a side elevational view of an aircraft 1100 that includes one or more components manufactured and/or repaired with the use of integral illuminated optical center finder and marking tool device illustrated in FIGS. 3-7. Such aircraft may include, for example, and without limitation, aircraft commercially-available from the Boeing Company of Chicago, Ill. As shown in FIG. 11, the aircraft 1100 includes one or more propulsion units 1104 coupled to a fuselage 1102, wing assemblies 1106 (or other lifting surfaces), a tail assembly 1108, a landing assembly 1110, a control system (not visible), and a host of other systems and subsystems that enable proper operation of the aircraft 1100. For example, at least a portion of the wing assemblies 1106 may include one or more components that are manufactured with the use of the laser projection systems that are calibrated via the calibration wall.

Embodiments of systems and methods in accordance with the present disclosure may provide significant advantages. The various embodiments of the integral illuminated optical center finder and marking device reduce or eliminate the need to assemble and disassemble an optical center finder, a marking tool, and a marking tool guide. Accordingly, by reducing or eliminating the need to assemble and dissemble marking components during the marking of a work piece surface, the various embodiments of the integral illuminated optical center finder and marking tool device may improve efficiency in marking the surface of work pieces, as well as reduce or eliminate component misplacement and/or loss due to assembly and disassembly of the components.

While embodiments have been illustrated and described above, many changes can be made without departing from the spirit and scope of the disclosure. Accordingly, the scopes of the embodiments are not limited by the disclosure. Instead, the embodiments of the disclosure should be determined entirely by reference to the claims that follow.

What is claimed is:

1. An integral illuminated optical center finder and marking tool device, comprising:

a base including a bore hole, the base to be positioned on a work piece surface;

a body disposed at least partially inside the bore hole and rotationally coupled to the base, the body having a first bore tunnel and a second bore tunnel;

an optical center finder disposed inside the first bore tunnel and a marking tool disposed inside the second bore tunnel; and a cover disposed on the body to enable access to the first and second bore tunnels in a first rotational position, and block access to the first bore tunnel or the second bore tunnel in a second rotational position, the base includes one or more detents and the body includes a concentric groove, the one or more detents and the concentric groove to couple the body to the base.

2. The device of claim 1, further comprising:

a light source disposed inside the base to provide illumination that is visible via the optical center finder to the work piece surface;

a switch disposed on the base to activate or deactivate the light source, the switch including one of a manual switch or a contact switch; and a friction pad or at least one conformable foot disposed on the base and positioned between the base and the work piece surface when the base is positioned on the work piece surface.

3. The device of claim 1, wherein the concentric groove includes at least one notch that locks the second bore tunnel into a location vacated by a first bore tunnel when the body is rotated with respect to the base, the body includes a first concentric indentation and the cover includes a second concentric indentation, further comprising an o-ring that is partially disposed inside the first concentric indentation and partially disposed inside the second concentric indentation to removably secure the cover to the body.

4. A method of using an integral illuminated optical center finder and marking tool device that includes a body and base, comprising, positioning the device on a work piece:

centering an optical center finder on a location on a work piece surface;

rotating the body of the device to center the marking tool at the location previously occupied by the optical center finder, the centering of the marking tool at the location being performed using alignment markings on the body and the base;

rotating a cover of the device to cover the optical center finder while leaving the marking tool uncovered; and marking the work piece surface with the marking tool by imparting a force on marking tool that is uncovered.

5. The method of claim 4, further comprising:

rotating the body of the device to center the optical center finder at the location previously occupied by the marking tool, the centering of the optical center finder at the location being performed using alignment markings on the body and the base;

rotating the protection cover of the device to uncover the optical center finder;

inspecting a mark created by the marking tool using the optical center finder;

repeating the rotation of the body of the device to center the marking tool at the location previously occupied by the marking tool, the centering of the marking tool at the location being performed using alignment markings on the body and the base;

repeating the rotation of the cover of the device to cover the optical center finder while leaving the marking tool uncovered; and repeating the marking of the work piece surface with the marking tool by imparting another force on marking tool that is uncovered.

6. A center finder and marking tool device, comprising:

a base including a bore hole, the base to be positioned on a work piece surface;

a body disposed at least partially inside the bore hole and rotationally coupled to the base, the body having a first bore tunnel and a second bore tunnel;

an optical center finder disposed inside the first bore tunnel;

a marking tool disposed inside the second bore tunnel; and a cover disposed over the body that provides access to the first and second bore tunnels when the cover is in a first position and blocks access to the first bore tunnel or the second bore tunnel when the cover is in a second position.

7. The device of claim 6, further comprising one or more light sources disposed in the body, the one or more light sources to provide illumination that is visible via the optical center finder to the work piece surface.

8. The device of claim 7 further comprising a switch to activate and deactivate the one or more light sources.

9. The device of claim 8, wherein the switch is a contact switch that activates the one or more light sources when the base is positioned on the work piece surface, and deactivates the one or more light sources when the base is moved away from the work piece surface.

10. The device of claim 6, further comprising a friction pad or at least one conformable foot disposed on the base and positioned between the base and the work piece surface when the base is positioned on the work piece surface.

11. The device of claim 6, further comprising one or more detents disposed inside the base, and a concentric groove disposed on the body, the one or more detents and the concentric groove to couple the body to the base.

12. The device of claim 11, wherein the concentric groove includes at least one notch that locks the second bore tunnel into a location vacated by the first bore tunnel when the body is rotated with respect to the base.

13. The device of claim 6, wherein the second bore tunnel includes an elastic member to return the marking tool to an original position after the marking tool contacts the work piece surface.

14. The device of claim 13, wherein the elastic member surrounds the marking tool inside the second bore tunnel.

15. The device of claim 6, wherein the marking tool comprises a penetrative marking tool.

16. The device of claim 6, wherein the marking tool comprises a manual center punch, an automatic center punch, and a drill bit, a felt-tip marker, a grease pencil, or a lead pencil.

17. The device of claim 6, wherein the body includes a first concentric indentation and the cover includes a second concentric indentation, further comprising an o-ring that is partially disposed inside the first concentric indentation and partially disposed inside the second concentric indentation to removably secure the cover to the body.

18. The device of claim 6, wherein an absolute center of the first bore tunnel and an absolute center of the second bore tunnel are of equal distance from an absolute center of the body.

19. The device of claim 6, wherein each of the optical center finder and the marking tool may be retained in the first bore tunnel and the second bore tunnel, respectively, by friction force or a retaining collar.

20. The device of claim 6, further comprising a bushing disposed inside the second bore tunnel.

21. A method of using a center marking tool device, comprising:

positioning the device on a work piece surface;

centering an optical center finder of the device on a location on the work piece surface;

rotating a body of the device to substantially center a marking tool of the device at the location previously occupied by the optical center finder;

covering the optical center finder while leaving the marking tool uncovered; and marking the work piece surface with the marking tool by imparting a force on the marking tool.

22. The method of claim 21, further comprising inspecting a mark created by the marking tool using the optical center finder.

23. The method of claim 21, further comprising:

rotating the body of the device to center the optical center finder at the location previously occupied by the marking tool;

repeating the rotation of the body of the device to center the marking tool at the location previously occupied by the marking tool; and repeating the marking of the work piece surface with the marking tool.

24. The method of claim 21, further comprising illuminating the work piece surface, the illumination being visible through the optical center finder.

25. The device of claim 21, wherein the covering the optical center finder while leaving the marking tool uncovered includes rotating a cover that provides access to the optical center finder and the marking tool in a first position to a second position that covers the optical center finder.

26. The method of claim 25, further comprising rotating the cover of the device to uncover the optical center finder.

27. A method of assembling a center finder and marking tool device, comprising:

providing a base that includes a bore hole, the base to be positioned on a work piece surface;

coupling a body that includes a first bore tunnel and a second bore tunnel to the base via the bore hole, the body rotates inside the bore hole;

disposing an optical center finder inside the first bore tunnel and a marking tool inside the second bore tunnel and disposing a cover over the body that provides access to the first and second bore tunnels when the cover is in a first position and blocks access to the first bore tunnel or the second bore tunnel when the cover is in a second position.

28. The method of claim 27, further comprising disposing one or more additional component to the base or the body, the one or more additional component including at least one of a friction pad, an o-ring, a light source, a manual switch, one or more contact switches, or one or more conformable feet.

* * * * *